US010758095B2

(12) United States Patent
Kling

(10) Patent No.: US 10,758,095 B2
(45) Date of Patent: Sep. 1, 2020

(54) DISPENSER WITH SUCTION CUPS

(75) Inventor: Robert Kling, Skene (SE)

(73) Assignee: Essity Hygiene and Health Aktiebolag, Gothenburg (SE)

( * ) Notice: Subject to any disclaimer, the term of this patent is extended or adjusted under 35 U.S.C. 154(b) by 1511 days.

(21) Appl. No.: 14/004,197

(22) PCT Filed: Mar. 10, 2011

(86) PCT No.: PCT/EP2011/053602
§ 371 (c)(1),
(2), (4) Date: Sep. 10, 2013

(87) PCT Pub. No.: WO2012/119657
PCT Pub. Date: Sep. 13, 2012

(65) Prior Publication Data

US 2013/0341346 A1 Dec. 26, 2013

(51) Int. Cl.

| | |
|---|---|
| ***A47K 10/24*** | (2006.01) |
| ***A47K 5/06*** | (2006.01) |
| *A47K 10/32* | (2006.01) |

(52) U.S. Cl.
CPC ..... *A47K 10/24* (2013.01); *A47K 5/06* (2013.01); *A47K 2010/3233* (2013.01); *A47K 2201/02* (2013.01)

(58) Field of Classification Search
CPC .. A47K 2201/00; A47K 2201/02; F16B 47/00
See application file for complete search history.

(56) References Cited

U.S. PATENT DOCUMENTS

| | | | | | |
|---|---|---|---|---|---|
| 1,739,801 | A | * | 12/1929 | Pitts | 220/483 |
| 2,263,956 | A | * | 11/1941 | Russell | 248/311.2 |
| 2,314,713 | A | * | 3/1943 | Kirch | 156/391 |
| 3,289,882 | A | * | 12/1966 | Filipowicz | 221/44 |
| 4,012,007 | A | | 3/1977 | Cunningham | |
| 4,020,975 | A | | 5/1977 | Stauffer | |

(Continued)

FOREIGN PATENT DOCUMENTS

| | | | |
|---|---|---|---|
| CN | 2479896 | Y | 3/2002 |
| CN | 201153902 | Y | 11/2008 |

(Continued)

OTHER PUBLICATIONS

English language translation of Office Action dated Feb. 20, 2015, by the Russian Patent Office in corresponding Russian Patent Application No. 2013145317. (3 pages).

(Continued)

*Primary Examiner* — Gene O Crawford
*Assistant Examiner* — Kelvin L Randall, Jr.
(74) *Attorney, Agent, or Firm* — Buchanan Ingersoll & Rooney PC

(57) ABSTRACT

A dispenser for hygienic articles such as wipes, towels, toilet paper or soap, includes a dispenser housing for containing the articles, and a fastener for fastening the dispenser to a fastening surface. The fastener includes a suction unit disposed on the outside of the dispenser facing the fastening surface. The fastener further comprise operating device by which the suction unit is operable so as to establish or release a sub-atmospheric pressure between the suction unit and the fastening surface. Access to the operating device is provided from inside the dispenser.

21 Claims, 7 Drawing Sheets

(56) References Cited

U.S. PATENT DOCUMENTS

| | | | | |
|---|---|---|---|---|
| 4,674,635 | A * | 6/1987 | Huldin et al. | 206/555 |
| 4,793,517 | A | 12/1988 | Washut | |
| 5,087,005 | A * | 2/1992 | Holoff et al. | 248/205.8 |
| 5,435,511 | A * | 7/1995 | Hsu | 248/206.3 |
| 5,706,986 | A | 1/1998 | Brandenburg et al. | |
| 6,053,356 | A * | 4/2000 | Emoff et al. | 221/45 |
| D449,474 | S * | 10/2001 | Conran | D6/518 |
| 6,631,869 | B1 * | 10/2003 | Kang | 242/598.5 |
| 7,997,522 | B2 * | 8/2011 | Titas | A47K 10/3818 221/33 |
| 8,875,943 | B2 | 11/2014 | Benedetti | |
| 2009/0120950 | A1 | 5/2009 | Titas et al. | |
| 2009/0127276 | A1 | 5/2009 | Rippl et al. | |
| 2010/0239407 | A1 * | 9/2010 | Mills | 414/800 |
| 2012/0272571 | A1 * | 11/2012 | Rex | 47/66.6 |
| 2013/0270292 | A1 * | 10/2013 | Sporre Thorburn et al. | 221/283 |

FOREIGN PATENT DOCUMENTS

| | | | |
|---|---|---|---|
| CN | 201624344 | U | 11/2010 |
| DE | 43 01 746 | A1 | 7/1994 |
| EP | 0861042 | A1 | 9/1998 |
| FR | 1 433 140 | A | 3/1966 |
| RU | 2152159 | C1 | 7/2000 |
| TW | 532131 | U | 5/2003 |
| WO | 97/17879 | A1 | 5/1997 |
| WO | WO 2007/035139 | A1 | 3/2007 |
| WO | 2011/002359 | A1 | 1/2011 |

OTHER PUBLICATIONS

Russian Decision on Grant dated Apr. 23, 2015 issued in the corresponding Russian Patent Application No. 2013145317/12(070066) and English translation (15 pages).

English-language translation of Chinese Notification of the First Office Action dated Jun. 3, 2015 issued in the corresponding Chinese Patent Application No. 201180069179.0 (8 pages).

Office Action dated Nov. 15, 2016, by the Mexican Patent Office in corresponding Mexican Patent Application No. MX/a/2013/010288. (4 pages).

Communication pursuant to Article 94(3) EPC dated Apr. 17, 2019, by the European Patent Office in corresponding European Patent Application No. 11 709 096.9. (5 pages).

International Search Report (PCT/ISA/210) dated Nov. 28, 2011, by the European Patent Office as the International Searching Authority for International Application No. PCT/EP2011/053602.

Written Opinion (PCT/ISA/237) dated Nov. 28, 2011, by the European Patent Office as the International Searching Authority for International Application No. PCT/EP2011/053602.

International Preliminary Report on Patentability (PCT/IPEA/409) dated Jul. 3, 2013, by the European Patent Office as the International Searching Authority for International Application No. PCT/EP2011/053602.

Notice of Granting Patent Right for Invention dated Jul. 6, 2016, by the State Intellectual Property Office of China in corresponding Chinese Patent Application No. 201180069179.0, and English translation. (8 pages).

* cited by examiner

DISPENSER WITH SUCTION CUPS

TECHNICAL FIELD

The present invention is related to a dispenser for disposable hygienic articles such as wipes, towels, toilet paper or soap.

Such dispensers for hygienic articles are commonly, but not exclusively mounted in restrooms or close to hand washbasins or sinks in public establishments, industrial or kitchen premises. They may also be used in industry, in order to dispense paper for e.g. cleaning at workbenches or wiping spills of any kind. The hygienic articles may form a stack inside the dispenser and be grasped by a user from the lower end of the stack through a dispensing aperture. Some hygienic articles may be provided on a roll, e.g. paper which at a free end may protrude from a dispenser. Others may be provided in liquid form, e.g. soaps or disinfectants.

PRIOR ART

Dispensers of the above mentioned kind may be arranged standing on a horizontal surface such as a tabletop. In general, however, they are mounted to a vertical fastening surface such as a bathroom wall or a mirror. Conventionally, the dispensers are fastened to the wall by means of screws or bolts, and they are provided with attachment holes in their rear walls to this extent. WO-A1-2007/035139 discloses an example.

In order to fasten the screws or bolts to the wall, corresponding bore holes have to be prepared, which is cumbersome and time consuming. Furthermore, in washrooms or other areas exposed to high moisture, the fastening surfaces are often covered with tiles or other water-tight layers. Forming bore holes in this kind of surface is particularly difficult and could, moreover, result in moisture intruding into the holes. The bore holes also leave visible marks if the screws or bolts are removed, e.g. because it is desired to mount the dispenser at another location.

The prior art also includes solutions for more easily fastening a dispenser to the wall. For example, it has already been envisaged to use suction cups for the purpose of attaching tissue boxes to both horizontal surfaces such as table tops and vertical surfaces such as tiled walls or bathroom mirrors. CN-Y-201153902 discloses a tissue box which can be fastened to smooth surfaces by means of suction cups arranged at the back side of the box body. A similar device is disclosed in US-A1-2009/0127276.

Cosmetic fluid containers which are attached to surfaces or walls by means of suction cups are also known. For example, U.S. Pat. No. 4,020,975 describes a dispenser for toothpaste, shampoo, or the like cosmetic materials, the dispenser being attached to the wall by means of conventional suction cups. A similar device is known from U.S. Pat. No. 4,793,517.

DISCLOSURE

It is the object underlying the present disclosure to provide a dispenser which can be easily but still reliably fastened to a fastening surface and removed there from. At the same time the dispenser shall not be easily detachable from the fastening surface. A fastening means for use in such a dispenser is also to be provided.

In order to achieve this object, the present disclosure provides a dispenser for hygienic articles comprising the features of claim 1. The dispenser includes a dispenser housing for containing said articles, and means for fastening the dispenser to a fastening surface, wherein these fastening means include a suction unit, which is disposed on the outside of the dispenser so that it faces the fastening surface when the dispenser is mounted to the fastening surface. In accordance with the present disclosure, the fastening means further comprise operating means, by means of which the suction unit is operable so as to establish or release a sub-atmospheric pressure between the suction unit and the fastening surface. Access to the operating means is provided from inside the dispenser.

The dispenser of the present disclosure provides the following advantages: First of all, it is fastened to the fastening surface by means of suction cups. Other than with prior art dispensers there are no screws or bolts necessary for attaching the dispenser, which allows for an easier, less costly, faster, and more flexible placement. In fact, the wall as such is not altered in any manner to attach the dispenser. After releasing the dispenser it is not noticeable where it has been located. It is therefore also possible to easily relocate the dispenser if needed.

Secondly, by means of the fastening means of the present disclosure, which include the suction unit and the operating means, the dispenser can be reliably attached to the wall. In this regard it is to be noted that there may be rather considerable forces acting onto the dispenser, these forces originating from the weight of the dispenser and the articles contained therein on the one hand, and from the actions carried out by the user on the other hand. For example, the user may pull tissues out of the dispenser or press an operating lever or the like in order to release a portion of soap from the dispenser. The dispenser should be attached to the wall so that it is not loosened also in the presence of these considerable forces. This is not necessarily possible by means of the conventional suction cups used for attaching the prior art devices recited above, which are not able to resists these considerable forces, so that the dispenser would fall down or at least change its position during use.

Therefore, according to the present disclosure, the operating means are provided for actuating the suction unit so as to create and maintain a sub-atmospheric pressure or underpressure between the suction unit and the facing fastening surface. Releasing the dispenser from the fastening surface is generally only possible by operating the operating means.

Preferred optional features are recited in the dependent claims.

The present disclosure encompasses dispensers in which the suction unit is disposed on the outside of the dispenser housing so as to face the fastening surface, and the operating means are disposed inside the dispenser housing. Only from inside the dispenser housing the operating means can be operated so as to release the suction unit from the fastening surface.

The present disclosure does, however, also encompass an alternative solution in which the dispenser further comprises a mounting bracket to which the dispenser housing can be attached. In this case, the fastening means are provided for fastening the mounting bracket to the fastening surface. Means are provided for releasing the dispenser housing from the mounting bracket. These release means are accessible from inside the housing, and the operating means are only accessible after having the dispenser housing released from the mounting bracket.

In both cases it will be advantageous if the housing further comprises a cover which needs to be opened in order to provide access to the interior of the housing. If the cover is also lockable, only authorized persons have access to the interior of the housing, so as to re-fill the dispenser, carry out maintenance operations, or else detach the dispenser from the wall from inside the dispenser housing if the need arises: after opening the housing they can either operate the operating means from within the housing or, if the dispenser includes the mounting bracket described above, first release the housing from the bracket so as to provide access to the operating means. By operating the operating means they can then detach the bracket from the wall if the need arises.

In contrast, without opening the dispenser housing, the operating means are not accessible so that for unauthorized persons it is very difficult, if not impossible to remove the dispenser from the wall. In fact, such dispensers are oftentimes used in public washrooms, and it must not be easily possible for the normal user to release the dispenser from the wall. By providing the lockable cover, and by providing access to the operating means only from inside the lockable dispenser housing, it is made sure that only authorized persons are capable of detaching the dispenser from the wall. This effect would not be achieved by using simple suction cups without any operating means, which can rather easily be released by e.g. simply lifting a part of the edge of the suction cup in order to release the underpressure.

Regarding the particular structure of the suction unit and operating means, there are many different types thereof known in the art, also for heavy loads. In the frame of the present disclosure it is encompassed to use any kind of suction unit and operating means currently known or still to be developed. In general, the suction unit will include a suction cup having a suction face on a side which faces the fastening surface. The suction cup is preferably essentially disk-shaped, although other shapes such as e.g. bellows shaped suction cups are also known. The suction cup is preferably made of resilient and/or flexible material. In the unstressed state, the suction face is essentially flat or slightly concave, relative to the fastening surface, becoming more concave if acted upon by means of the operating means.

In case particular, more sophisticated suction cups are used, as they are also per se known in the art, it will even be possible to hang the dispenser to a wall having a rougher surface and not only to relatively smooth surfaces such as tiled walls or mirrors.

To enable the suction unit to be acted upon by the operating means, the suction unit comprises, in addition to the suction cup as such, an operable element on the side of the suction cup opposite the suction face. The operable element engages with the operating means, wherein the engagement could be a direct or an indirect one.

The operable element may, for example, be provided in the form of a stem projecting from the side of the suction cup opposite the suction face. In this case the operating means may be provided in the form of an actuating nut engaging with the stem. This engagement could for example be a direct, threaded engagement, i.e. an external thread on the stem engaging with an internal thread in the actuating nut.

Several alternatives other than the stem and actuating nut can be envisaged to constitute the operable element and the operating means, respectively. A lever could be provided as the operating means, working on a link with an eyelet or hook as the operable element. A turning handle could be working on any type of screw. A wedge could be provided for pressing into an eyelet. A cog wheel could be provided for acting on a rack, etc. One could also think of providing a simple circlip as the operating means, engaging with a groove formed in a stem or pin of the suction unit which would be the operable element in this case.

In any of these cases the operable element of the suction unit may extend through an opening in a wall of the dispenser which faces the fastening surface. In this manner it is easily possible to have the suction cup provided on the outside of the dispenser, facing the fastening surface, whereas the operating means engaging with the operable element of the suction unit is disposed inside the housing.

Furthermore, irrespective of the particular shape and constitution of the operating means, it may be preferable to have the operating means provided in a recess formed in the dispenser. This makes sure that the operating means does not interfere with any of the remaining parts accommodated inside the housing or the articles accommodated there within, respectively.

As already explained, the fastening means are preferably arranged and constructed for fastening the dispenser to a vertical fastening surface such as a tiled wall or a mirror. The present disclosure, however, also encompasses embodiments in which the fastening means are used to attach or fasten the dispenser to a horizontal surface such as a tabletop, or to a slanted surface. Depending on the type, size and number of suction cups, the dispenser could even be fastened to a slightly curved surface. Even attachment to a ceiling is possible.

The dispenser of the present disclosure may further comprise an additional support structure arranged between the suction unit and the outside of the dispenser. The support structure may, for example, be provided in the form of a support ring. The support ring could be integrated with the housing or be an extra part which is attached by adhesive or by snap-in taps or the like. In any event, the support structure is preferably so arranged and constructed that the suction unit, when operated, adapts to the shape of the support structure.

In order to maintain the dispenser in a correct position and to control that the attachment forces are well balanced between the fastening points, the dispenser may further comprise support means provided on the wall of the dispenser facing the fastening surface, for adjusting the distance between the dispenser wall and the fastening surface.

Although only one suction unit may in some cases be sufficient to reliably fasten the dispenser to the wall, a dispenser of the present disclosure preferably comprises two or more suction units so as to provide a secure attachment. Each suction unit could be associated with an individual operating means, or one operating means could work on more than one suction unit.

The present disclosure further provides a fastening means for use in the dispenser described above, including the suction unit and the operating means.

BRIEF DESCRIPTION OF THE FIGURES

The various aspects of the present disclosure, including its particular features and advantages, will be readily understood from the following detailed description and the accompanying drawings, in which.

DETAILED DESCRIPTION OF A PREFERRED EMBODIMENT

Figure 1:
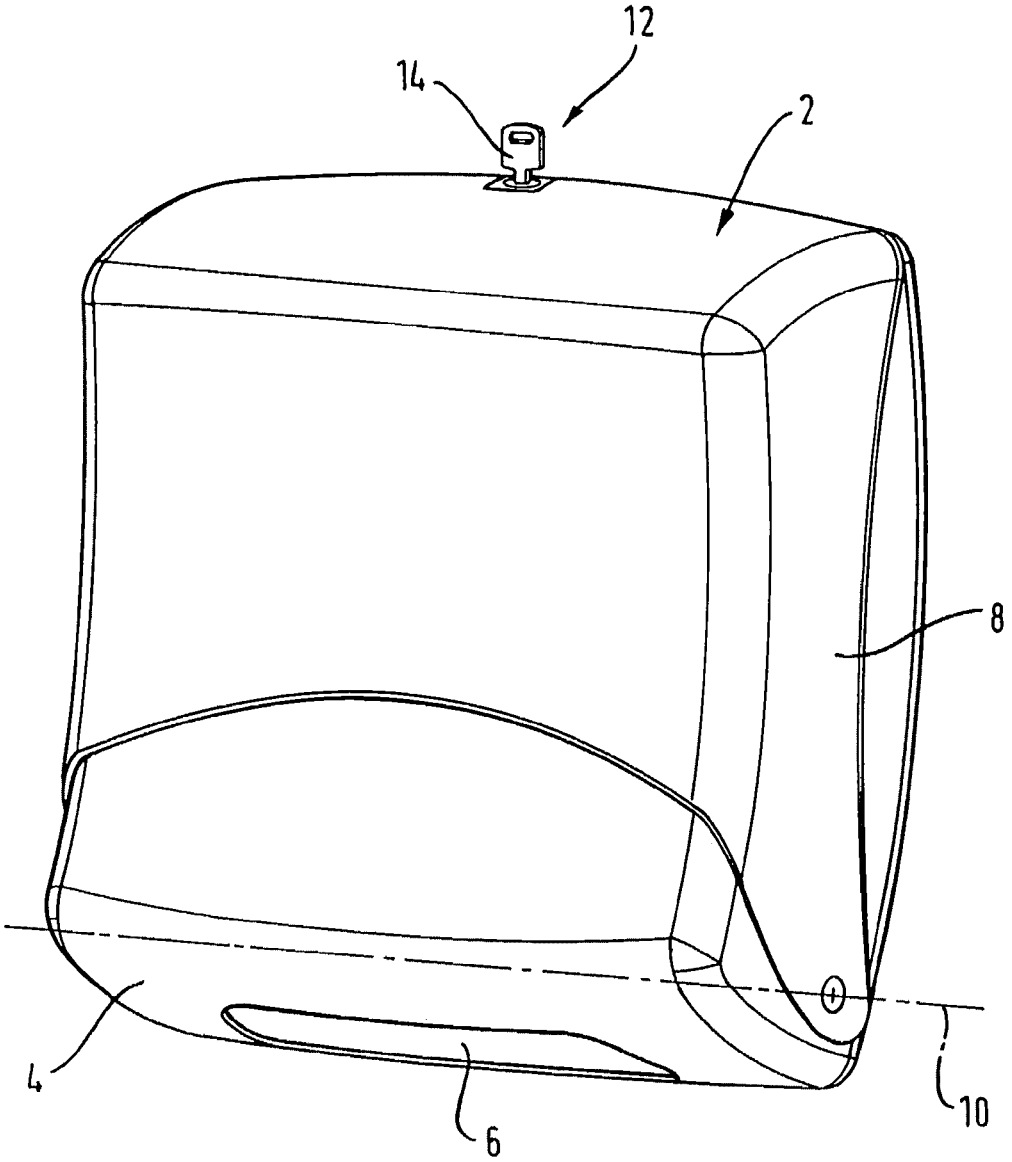
FIG. 1 illustrates a dispenser according to a preferred embodiment of the present disclosure.

FIG. 1 illustrates a dispenser 2 according to a preferred embodiment of the present disclosure. The dispenser 2 is adapted to contain a stack of flat hygienic articles such as towels. The dispenser 2 comprises a housing 4, which is constituted by at least side walls, a rear wall and a bottom wall. The rear wall of the housing 4 is to be fastened to a fastening surface such as a tiled wall or mirror.

The bottom wall of the housing 4 is provided with a dispensing aperture 6, from which the hygienic articles are grasped by a user. A cover 8 is arranged on a front side of the housing 4. The cover 8 may be pivoted about an essentially horizontal axis 10 from the illustrated closed position to an open position, in which an access opening provides access to an interior of the housing 4. At its upper end the cover 8 is provided with a locking mechanism 12. The locking mechanism 12 may comprise a removable key 14. The cover 8 may thus be locked to the housing 4 to prevent access to the access opening 11.

Figure 2:
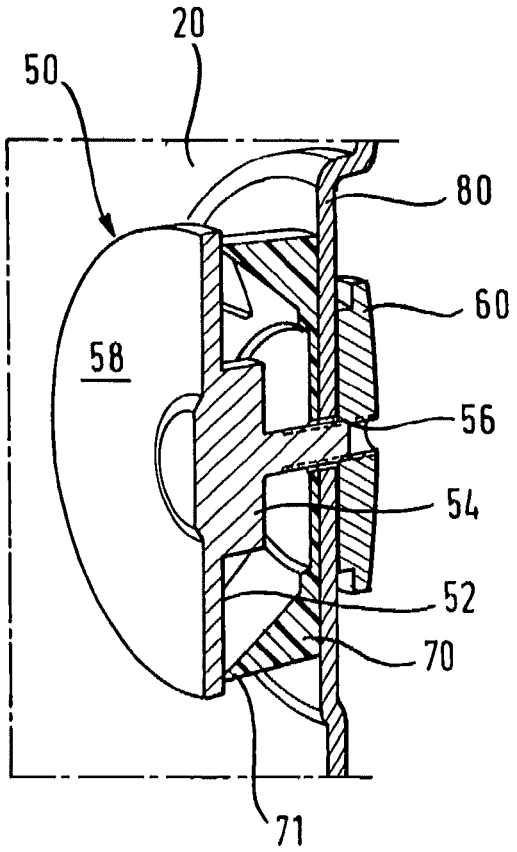
FIG. 2 shows fastening means of the dispenser of FIG. 1, including a suction unit and operating means.

FIG. 2 shows means for fastening the dispenser of FIG. 1 to a fastening surface such as a vertical tiled wall or mirror. The fastening means are generally comprised of a suction unit 50 disposed on the outside of the rear wall of the dispenser housing 4, which is designated 20 in FIG. 2. The suction unit 50 is, in this preferred embodiment, constituted by a suction cup 52 having a suction face 58 on the side facing the fastening surface (not shown) to which the dispenser is to be fastened. The suction unit 50 further comprises a stem 54 extending on the side opposite the suction face 58.

The suction cup 52 is essentially disk-shaped. It is made from a flexible, resilient and air-tight material such as a vinyl compound, e.g. an injection moldable PVC-P compound. The suction cup 52 could as well be made from blue vinyl, PUR (polyurethane rubber), CR (chloroprene rubber (neoprene)), SIT (silicone), NBR (nitrile rubber), or HNBR (hydrogenated nitrile butadiene rubber), to mention some examples. The stem 54, in contrast, is made from a more rigid material, e.g. metal or plastic such as PA, ABS, PP, PE, PC, or the like. The stem 54 protrudes in a direction essentially perpendicular to the suction face 58. The stem 54 is arranged so as to extend through an opening formed in the rear wall 20 of the dispenser housing 4.

The fastening means further include an operating means disposed inside the housing 4, which in this embodiment is provided in the form of an actuating nut 60. The nut 60 is provided with a female thread engaging with a male thread formed on at least part of the stem 54 of the suction unit 50. In other words, the nut 60 engages with a part of the stem 54 extending into the inside of the dispenser housing.

The operating means, i.e. the actuating nut 60 is provided for acting upon the suction unit 50 so as to establish a sub-atmospheric pressure or underpressure between the suction face 58 of the suction cup 52 and the fastening surface to which the dispenser is to be attached. In its reverse action, the operating means is used to release the sub-atmospheric pressure, so that the suction cup 52 can be loosened from the fastening surface.

In the unstressed state, the suction face 58 is essentially flat or slightly concave, and it becomes more concave if the suction unit 50 is acted upon by means of the actuating nut 60:

due to the threaded engagement between the nut 60 and the stem 54, if the actuating nut 60 is turned, the stem 54 is moved along its longitudinal axis and pulled further into the dispenser housing 4. This in turn results in the center portion of the suction face 58 becoming drawn further away from the fastening surface while the peripheral portion of the suction face 58 substantially stays in place. A sub-atmospheric pressure is created thereby between the suction face 58 and the fastening surface, which has the effect that the suction unit 50 is attached firmly to the fastening surface.

As an alternative to the actuating nut there may be other types of operating means such as levers, wing nuts, or the like acting upon the operable element of the suction unit. The actuating nut 60 used in this embodiment is, however, advantageous insofar as it consumes relatively little space. This applies all the more if, as in the present embodiment, the nut 60 is disposed in a shallow recess 80 formed in the rear wall 20 of the housing 4. This makes sure that the nut 60 does not interfere with any of the remaining parts accommodated inside the housing or the articles accommodated there within, respectively.

In order to support the fastening of the suction unit 50 to the fastening surface a support structure may additionally be provided. In the present embodiment, such a support structure is present in the form of a support ring 70, which is an additional element attached to the outside of the rear wall 20 of the housing. The support ring 70 is essentially cup-shaped, with the shape thereof corresponding to the shape of the suction cup 52 in the operated position. When operating the suction unit as described above to attach the dispenser to the wall, the suction cup 52 further and further conforms to the shape of the support ring 70. At the same time, a rim 71 of the support ring 70 holds the circumference of the suction cup against the wall when the center thereof is pulled away from the wall by operating the actuating nut 60. In this manner the support ring 70 helps bringing and maintaining the suction unit in shape, respectively.

Figure 3:
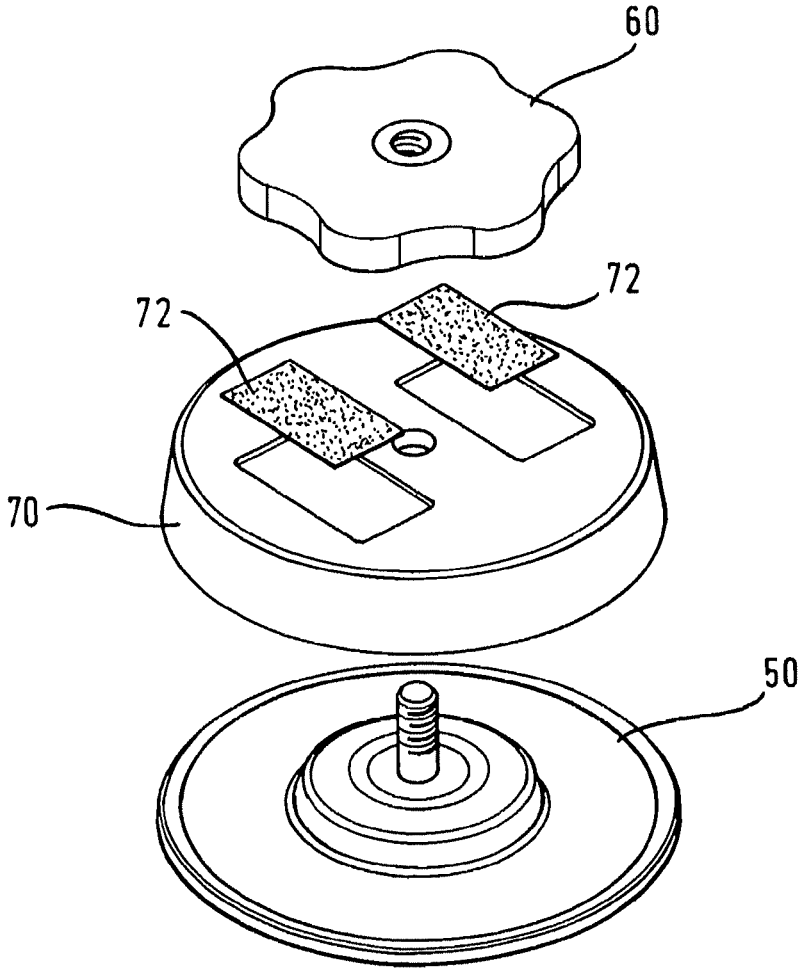
FIG. 3 is a perspective view of the fastening means of FIG. 2.

FIG. 3 is a perspective view of the fastening means of FIG. 2, including the suction unit 50, actuating nut 60, and support ring 70. The support ring 70 can advantageously be fastened to the back of the dispenser wall with adhesive stickers 72. As an alternative the support ring 70 could also be fully integrated in the housing, meaning that the support ring is made in the same process step as the housing. For example, by suitably designing the casting mould for injection moulding the back wall, the support ring 70 could be injection moulded as an integrated part of the back wall. In case the dispenser includes a mounting bracket, such as in the embodiment discussed further below with reference to FIG. 6, the support ring 70 could likewise be formed as an integrated part of the bracket.

Figure 4:
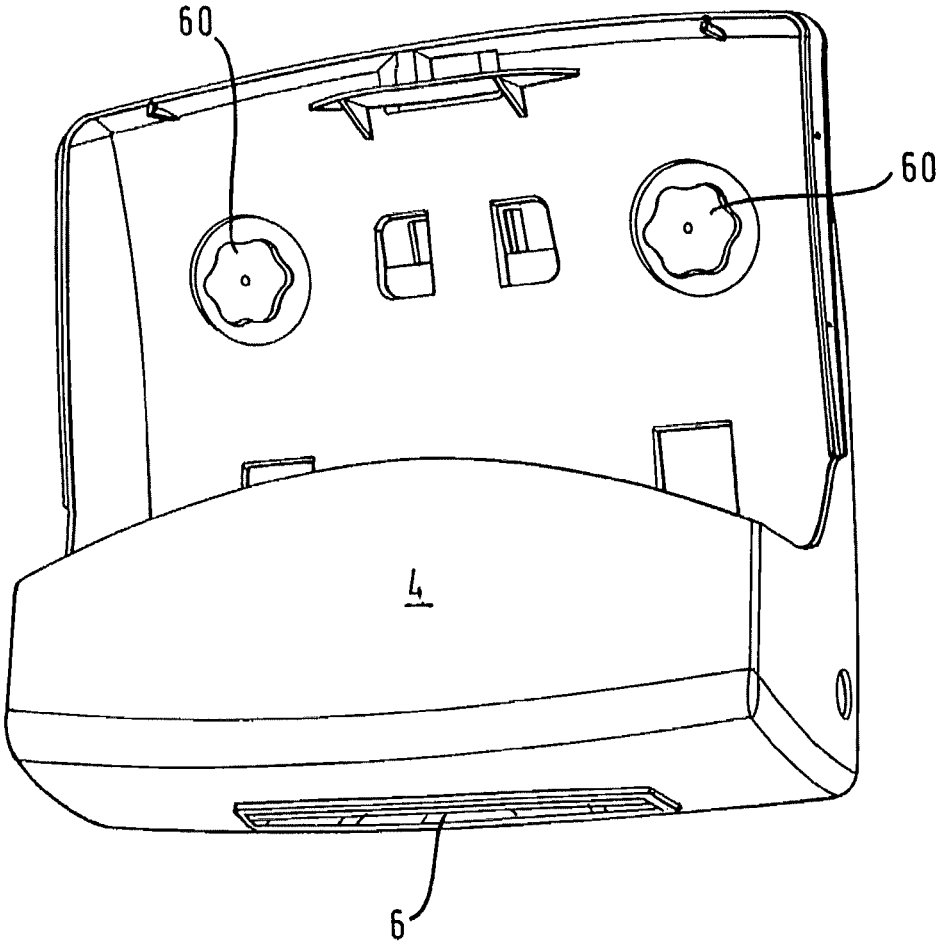
FIG. 4 is a front view of a dispenser similar to the one of FIG. 1, with the cover being removed.
Figure 5:
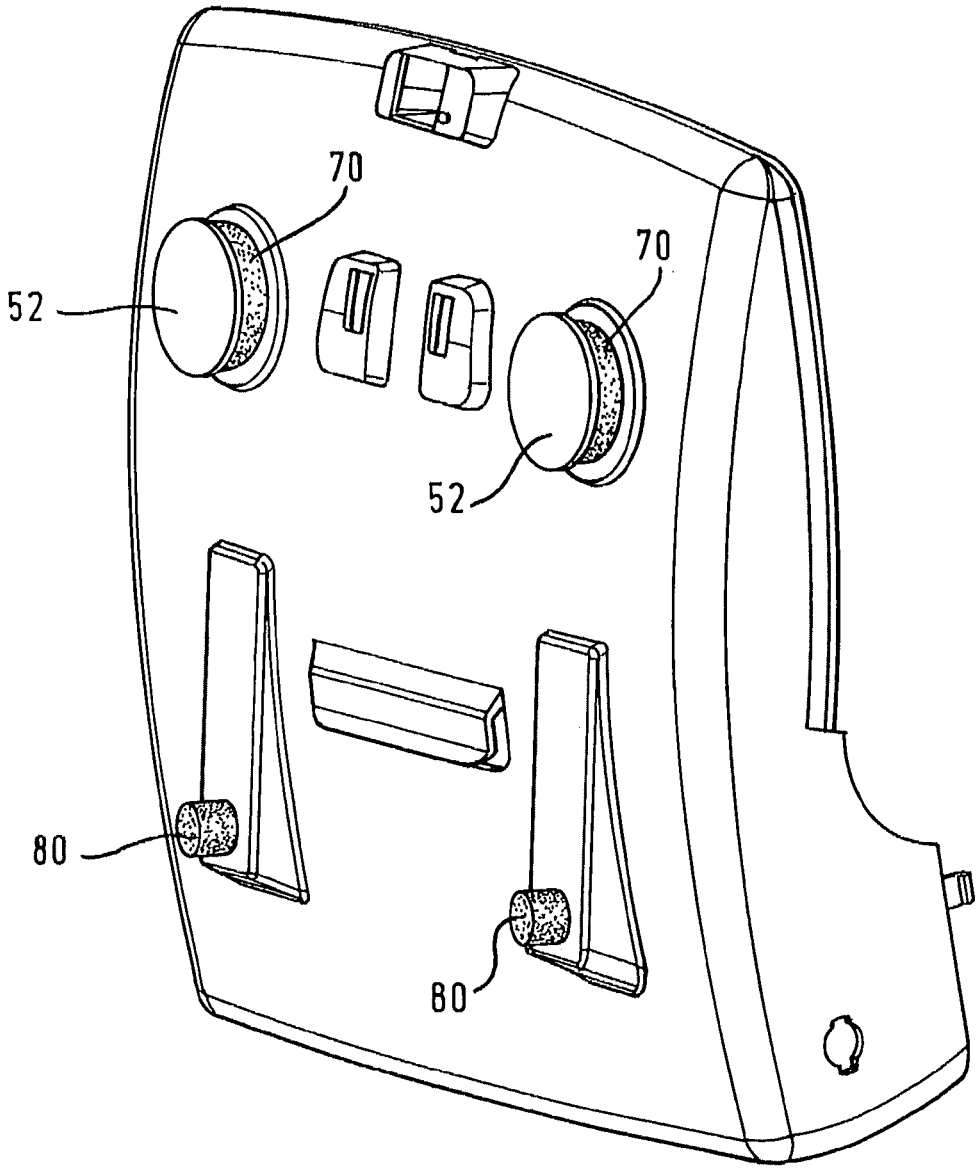
FIG. 5 is a rear view of the dispenser of FIG. 4.

FIGS. 4 and 5 are a front view and a rear view, respectively, of a dispenser similar to the one of FIG. 1, with the cover being removed. The dispenser is attached to the wall by means of two suction units 50 of the type shown in FIG. 2 and discussed above.

Accordingly, in the front view of FIG. 4, the actuating nuts of the two suction units 50 are visible, whereas in the rear view of FIG. 5, the suction cups 52 and support rings 70 are shown.

Reference numeral 80 in FIG. 5 designates supporting pads which in this embodiment are used for suitably defining the position of the dispenser when attached to the wall. As the suction cups 52 will often stand out a bit from the dispenser rear wall, such supporting pads can be added to adjust the distance between the dispenser rear wall and the fastening surface, so that the dispenser is oriented vertically. The pads 80 are preferably made from a relatively soft material having a high friction coefficient, such as rubber, to keep the dispenser steady. The pads can be integrated already at delivery of the dispenser or provided as add-ons, in which case they may be attached by e.g. glued tape.

Using the fastening means of the present disclosure, the dispenser can be easily but still reliably attached to the wall. Bore holes in the fastening wall can be avoided. In fact, the wall as such is not altered in any manner to attach the dispenser, and after releasing the dispenser it is not noticeable where it has been located. It is therefore also possible to easily relocate the dispenser if needed.

Furthermore, in the dispenser of this embodiment, the actuating nut 60 is only accessible from the inside of the dispenser housing 4. Operating the actuating nut 60 is only possible after having opened the cover 8 of the housing by means of the key 14. Operating the actuating nut 60 to detach the dispenser from the wall is, therefore, only possible for authorized persons. In contrast, without opening the dispenser housing 4, the nut 60 is not accessible so that for unauthorized persons it is very difficult, if not impossible to remove the dispenser from the wall.

Figure 6:
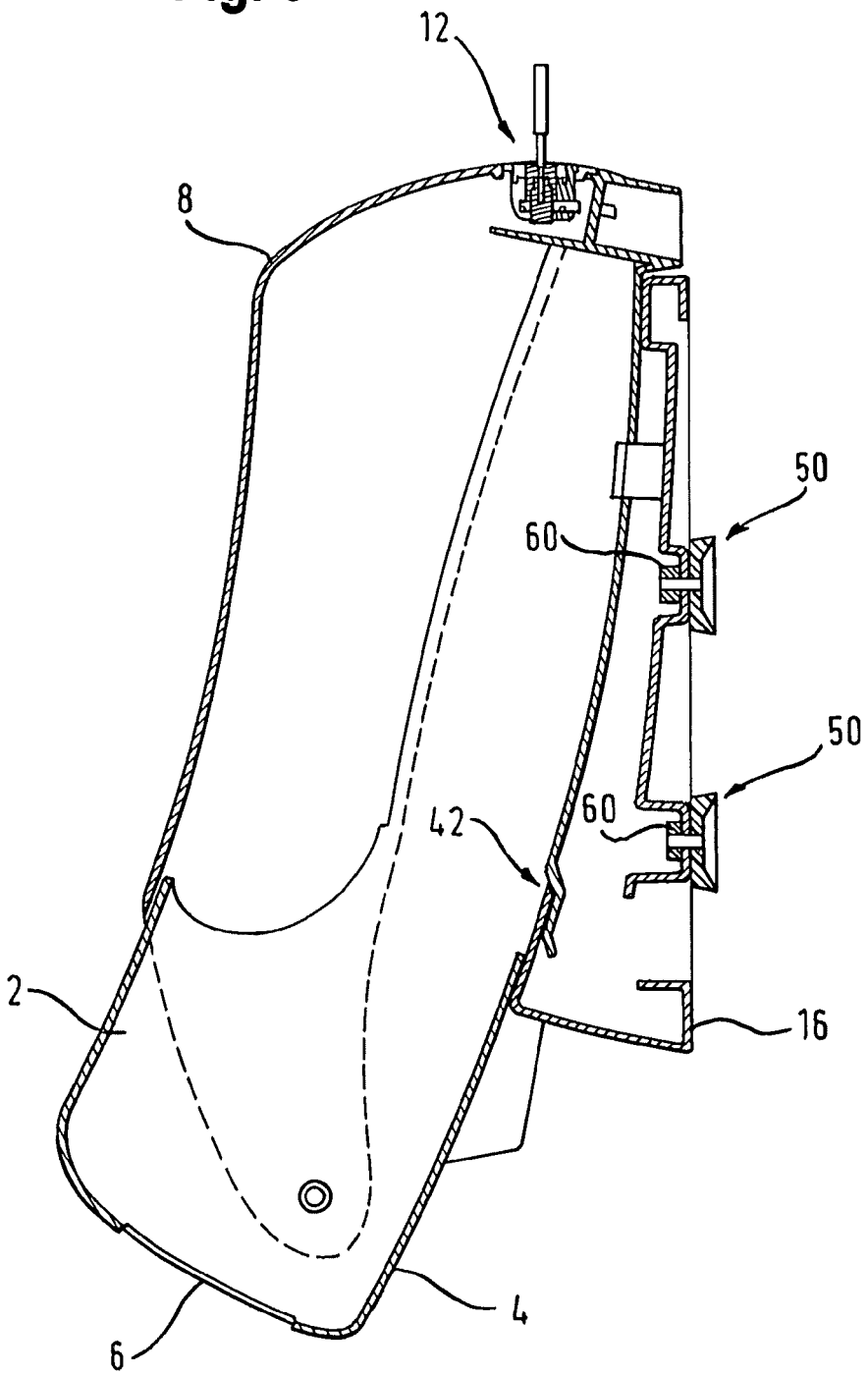
FIG. 6 illustrates a section through a dispenser according to another embodiment of the present disclosure, including a mounting bracket.

FIG. 6 shows an alternative embodiment of a dispenser according to the present disclosure. This dispenser differs from the one shown in FIG. 1 and discussed above in that the housing 4 is not directly attached to the wall, but the dispenser additionally includes a mounting bracket 16 which is mounted to the wall by means of the suction unit and operating means. The dispenser housing is in turn attached to the mounting bracket 16.

Also in this embodiment, the dispenser housing 4 is provided with the dispensing aperture 6 at its lower end and the access opening covered by the cover 8, which may be locked by means of the locking mechanism 12.

In the present embodiment, releasing the dispenser housing 4 from the mounting bracket 16 is only possible after having opened the cover 8. Furthermore, only after the dispenser housing 4 has been removed from the mounting bracket 16, the nut 60 for operating the suction unit 50 is accessible. Consequently, and similar as in the first embodiment, the dispenser 2 can only be detached from the wall after the lockable cover 8 has been opened by an authorized person. In this embodiment, however, an additional step is necessary to completely detach the dispenser: the dispenser housing 4 has to be released from the bracket 16 as described above. Subsequently the bracket 16 has to be dismounted from the wall by operating the nut 60 and releasing the suction unit 50.

The present embodiment uses a particular kind of mounting bracket 16 and a guiding interconnection 42 between the dispenser 2 and the mounting bracket 16. The present disclosure is, however, also applicable to other types of mounting brackets 16, as long as the mounting bracket is arranged and constructed for being mounted to the wall by means of a suction unit and operating means as described above, and the dispenser housing is in turn attached to the mounting bracket. The dispenser housing could also be attached to the mounting bracket by simply using, for example, screws or bolts.

Figure 7A:
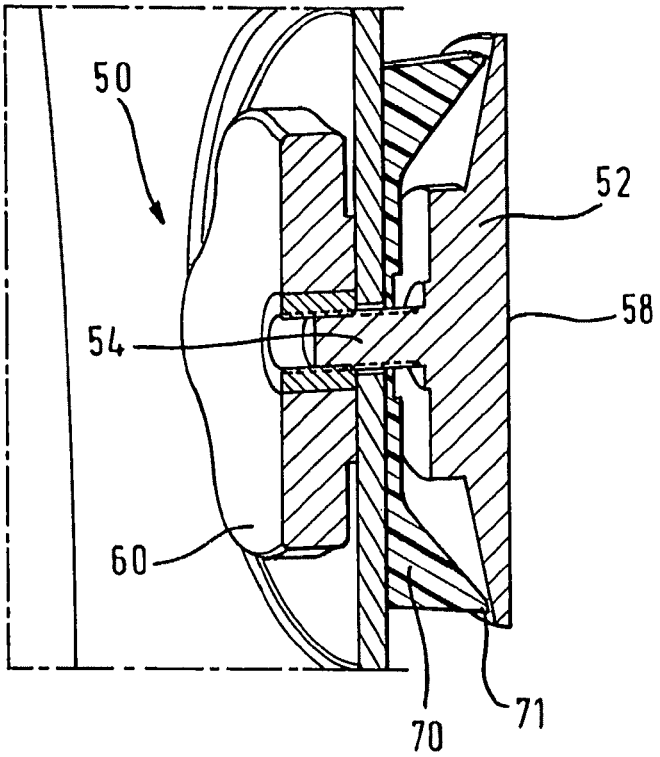
FIG. 7 illustrates a suction unit during operation.
Figure 7B:
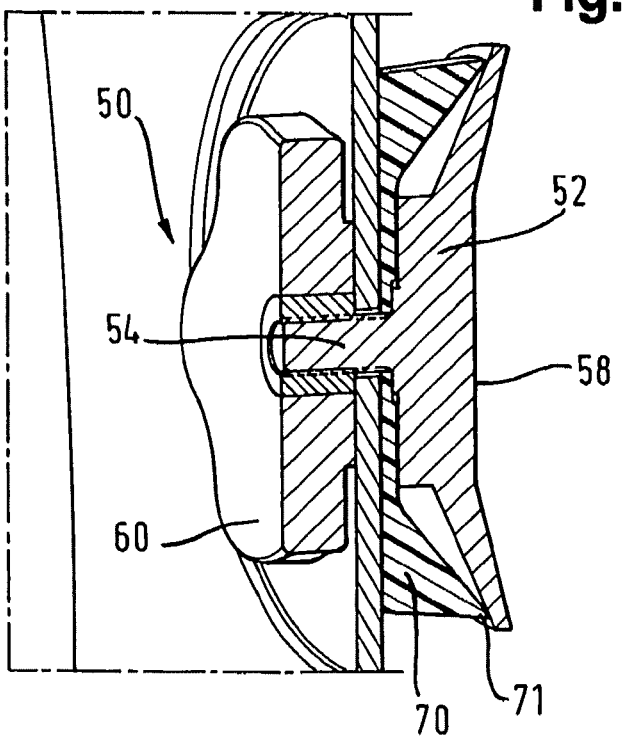

With reference to FIGS. 7*a* and 7*b*, it will now be explained how the suction unit 50 is preferably operated in order to achieve the proper suction force for attaching the dispenser to the fastening surface. The suction unit 50 as such is constituted as shown in FIGS. 2 and 3. Note that, depending on which one of the embodiments discussed above is referred to, the part between the actuating nut 60 and the support ring 70 can be either the dispenser back wall or the bracket wall.

FIG. 7*a* shows the starting situation in which the suction unit 50 is in the relaxed state. In this state, the suction cup 52 is pressed against the wall to expel as much air as possible. (To this extent it may be favourable to have a suction cup 52 having a flat suction face 58, as it is also shown in FIG. 5*a*.) By actuating the operating means, the center of the suction cup 52 is then pulled away from the wall, while holding the rim or circumference thereof down. In the present embodiment, this is done by means of the rim 71 of the support ring 70.

The actuating nut 60 is then operated until it has assumed a predetermined, locked position. This final state of the suction unit 50 is shown in FIG. 7*b*.

Even though the present disclosure has been described with reference to exemplary embodiments, many different alterations, modifications and the like will become apparent for those skilled in the art.

In particular, although the embodiments described above refer to a dispenser for dispensing stacked towels, it goes without saying that the contents of the dispenser is not important for the present disclosure, and the present disclosure can be used for many other types of dispensers for disposable hygienic articles.

Furthermore, although the dispensers discussed above are attached to the wall by means of two suction units 50, it will be appreciated that several suction units 50 will preferably be used in practice. In fact, three suction units 50 distributed across the rear wall 20 of the dispenser housing 4 would create a favourable fastening force, also securing the dispenser housing 4 against rotation or tilting. On the other hand, a single suction unit 50 may suffice in some cases, e.g. if the dispenser to be attached is fairly small and/or lightweight.

What is claimed is:

1. A dispenser for disposable hygienic articles, comprising:

a dispenser housing for containing said articles, a fastener for fastening the dispenser to a fastening surface, the fastener including a suction unit disposed on an outside of the dispenser facing the fastening surface, and comprising operating means by which the suction unit is operable so as to establish or release a sub-atmospheric pressure between the suction unit and the fastening surface, a mounting bracket to which the dispenser housing is attachable, the fastener being provided for fastening the mounting bracket to the fastening surface, and means for releasing the dispenser housing from the mounting bracket, wherein the means for releasing are accessible from inside the housing, and the operating means are only accessible after having the dispenser housing released from the mounting bracket.

2. The dispenser of claim 1, wherein the suction unit includes a suction cup having a suction face on a side facing the fastening surface.

3. The dispenser of claim 2, wherein the suction unit further comprises an operable element on a side of the suction cup opposite the suction face, for engagement with the operating means.

4. The dispenser of claim 3, wherein the operable element is provided in the form of a stem projecting from the side of the suction cup opposite the suction face, and the operating means is provided in the form of an actuating nut engaging with the stem.

5. The dispenser of claim 3, wherein the operable element of the suction unit extends through an opening in a wall of the dispenser.

6. The dispenser of claim 1, wherein the operating means is provided in a recess formed in the dispenser.

7. The dispenser of claim 1, wherein the fastener is arranged and constructed for fastening the dispenser to a vertical fastening surface.

8. The dispenser of claim 1, further comprising an additional support structure arranged between the suction unit and the outside of the dispenser, wherein the support structure is in the form of a support ring.

9. The dispenser of claim 8, wherein the suction unit, when operated, adapts to the shape of the additional support structure.

10. The dispenser of claim 1, further comprising support means provided on a wall of the dispenser facing the fastening surface, for adjusting a distance between the dispenser wall and the fastening surface.

11. The dispenser of claim 1, comprising at least two suction units.

12. The dispenser of claim 1, wherein the means for releasing is concealed from view when the dispenser is seen from a top view looking down onto the dispenser.

13. The dispenser of claim 1, wherein the dispenser housing is attachable to the mounting bracket via an interconnection in which a portion of a rear wall of the dispenser housing contacts a first surface of a protruding wall of the mounting bracket and another portion of the rear wall of the dispenser housing contacts a second surface of the protruding wall of the mounting bracket, wherein the first surface of the protruding wall faces the dispenser housing and the second surface of the protruding wall faces in an opposite direction than the first surface.

14. The dispenser of claim 1, wherein the means for releasing comprises a screw-less interconnection between a lip of the dispenser housing and a wall of the mounting bracket.

15. A dispenser for disposable hygienic articles, comprising:

a dispenser housing for containing said articles, a mounting bracket to which the dispenser housing is attachable via an interconnection in which a portion of a rear wall of the dispenser housing contacts a first surface of a protruding wall of the mounting bracket and another portion of the rear wall of the dispenser housing contacts a second surface of the protruding wall of the mounting bracket, wherein the first surface of the protruding wall faces the dispenser housing and the second surface of the protruding wall faces in an opposite direction than the first surface, a fastener for fastening the dispenser to a fastening surface, the fastener including a suction unit disposed on an outside of the dispenser facing the fastening surface, and comprising operating means by which the suction unit is operable so as to establish or release a sub-atmospheric pressure between the suction unit and the fastening surface, wherein access to the operating means is provided from inside the housing of the dispenser, the housing further comprises a cover which is opened in order to provide access to an interior of the housing, the cover being lockable, and access to the operating means is only provided after opening the cover.

16. The dispenser of claim 15, wherein the suction unit includes a suction cup having a suction face on a side facing the fastening surface.

17. The dispenser of claim 15, wherein the operating means is provided in a recess formed in the dispenser.

18. The dispenser of claim 15, wherein the fastener is arranged and constructed for fastening the dispenser to a vertical fastening surface.

19. The dispenser of claim 15, further comprising an additional support structure arranged between the suction unit and the outside of the dispenser, wherein the support structure is in the form of a support ring.

20. The dispenser of claim 15, further comprising support means provided on a wall of the dispenser facing the fastening surface, for adjusting a distance between the dispenser wall and the fastening surface.

21. The dispenser of claim 15, comprising at least two suction units.

* * * * *